US006209293B1

(12) United States Patent
Powers

(10) Patent No.: US 6,209,293 B1
(45) Date of Patent: Apr. 3, 2001

(54) PACKING APPARATUS FOR PACKING MULTIPLE LAYERS OF CONTAINERS INTO A RECEPTACLE

(75) Inventor: Whitney S. Powers, Pine City, NY (US)

(73) Assignee: Box Loader, LLC, Pine City, NY (US)

( * ) Notice: Subject to any disclaimer, the term of this patent is extended or adjusted under 35 U.S.C. 154(b) by 0 days.

(21) Appl. No.: 09/339,897

(22) Filed: Jun. 25, 1999

(51) Int. Cl.[7] ..... B65B 5/10

(52) U.S. Cl. ..... 53/475; 53/247; 53/244; 53/251

(58) Field of Search ..... 53/475, 476, 247, 53/473, 248, 500, 534, 244, 251

(56) References Cited

U.S. PATENT DOCUMENTS

| | | | | |
|---|---|---|---|---|
| 2,666,562 | | 1/1954 | Birch . | |
| 2,946,164 | | 7/1960 | Potts et al. . | |
| 3,130,528 | | 4/1964 | Andersen . | |
| 3,168,204 | | 2/1965 | Voullaire . | |
| 3,209,923 | * | 10/1965 | Bargel et al. | 53/247 |
| 3,327,450 | * | 6/1967 | Carter | 53/475 |
| 3,368,324 | | 2/1968 | Leedy . | |
| 3,386,224 | | 6/1968 | Shuttleworth . | |
| 3,601,951 | | 8/1971 | Bargel et al. . | |
| 3,618,790 | | 11/1971 | Carmody . | |
| 3,701,297 | | 10/1972 | Kovic . | |
| 4,402,173 | | 9/1983 | Thierion . | |
| 4,566,836 | | 1/1986 | Berger et al. . | |
| 4,583,910 | | 4/1986 | Borgman et al. . | |
| 4,603,897 | | 8/1986 | Foulke et al. . | |
| 4,662,668 | | 5/1987 | Hufford . | |
| 4,683,654 | | 8/1987 | Scholten et al. . | |
| 4,763,941 | | 8/1988 | Sniderman . | |
| 4,832,180 | | 5/1989 | Ferrero . | |
| 4,936,566 | | 6/1990 | Hiramatsu . | |
| 4,978,275 | | 12/1990 | Reid et al. . | |
| 5,060,455 | | 10/1991 | Schmeisser . | |
| 5,188,411 | | 2/1993 | Golden . | |
| 5,201,560 | | 4/1993 | Golden . | |
| 5,207,467 | | 5/1993 | Smith . | |
| 5,308,132 | | 5/1994 | Kirby et al. . | |
| 5,310,232 | | 5/1994 | Schmidt . | |
| 5,324,087 | | 6/1994 | Shimose et al. . | |
| 5,335,482 | | 8/1994 | Kinigakis et al. . | |
| 5,385,441 | | 1/1995 | Swapp et al. . | |
| 5,407,315 | | 4/1995 | Suga . | |
| 5,415,518 | | 5/1995 | Montgomery . | |
| 5,487,257 | * | 1/1996 | Domeier et al. | 53/534 |
| 5,611,193 | * | 3/1997 | Farrelly | 53/475 |
| 5,622,031 | * | 4/1997 | Meives | 53/473 |
| 5,661,949 | | 9/1997 | Blanc . | |
| 5,862,651 | * | 1/1999 | Stewart et al. | 53/534 |

FOREIGN PATENT DOCUMENTS

| | | |
|---|---|---|
| 29 16 338 A1 | 10/1979 | (DE) . |
| 2 240 086 | 7/1991 | (GB) . |
| 4-352618 | 12/1992 | (JP) . |

* cited by examiner

*Primary Examiner*—Stephen F. Gerrity
*Assistant Examiner*—Sam Tawfik
(74) *Attorney, Agent, or Firm*—Seidel, Gonda, Lavorgna & Monaco, PC

(57) ABSTRACT

A packing apparatus for packing multiple layers of containers into a receptacle is shown. The packing apparatus includes a placement assembly and a carriage assembly. The placement assembly includes a plurality of pickup devices mounted on one end of a moveable arm. The arm is moveable so that the pickup devices can pick up and transfer the containers to the receptacle. The receptacle is supported by the carriage assembly. The carriage assembly includes a moveable carriage that adjustably moves the position of the receptacle, relative to the placement assembly, to enable the articles to be placed into the receptacle in a preselected pattern. A system controller controls the timing, sequence, and movement of the placement assembly and the carriage assembly, both individually and relative to each other, in order to place and pack the containers into the receptacle in the preselected pattern.

30 Claims, 7 Drawing Sheets

PACKING APPARATUS FOR PACKING MULTIPLE LAYERS OF CONTAINERS INTO A RECEPTACLE

FIELD OF THE INVENTION

The present invention relates to a packing apparatus. In particular, the present invention relates to a packing apparatus for packing multiple layers of containers into a receptacle in a preselected pattern.

BACKGROUND OF THE INVENTION

As part of material handling systems, it is common to pack manufactured products and goods, such as containers, into receptacles, such as a case or a box, for shipment. Typically, the containers to be packed are assembled at a designated packing location and transferred by an automated packing device or similar type of apparatus to the receptacle. The packing device reduces the time and labor costs that would otherwise be required to pack the containers into the receptacle manually.

Often, to facilitate packing, the containers at the packing location are prearranged into a pattern before they are picked up and packed into the receptacle. The pattern is selected relative to how the containers will be packed in the receptacle. The prearrangement of the containers into a pattern is commonly used when multiple layers of the same pattern of containers are to be packed into a single receptacle. However, packing devices that rely upon the containers to be prearranged into a pattern before packing are inherently large and costly to operate. They are also limited to packing the containers into the receptacle in the prearranged pattern, rather than having the flexibility to pack the containers in a variety of different preselected patterns.

In addition, many packing devices pack the containers by using a technique that simply drops the containers into the receptacle. The dropping technique is inherently unreliable because many of the containers often fall out of position, and can prevent additional containers from being packed in the receptacle. The problems associated with the dropping technique are even more apparent when containers of relatively light weight, such as empty plastic containers, are packed by packing devices. Empty plastic containers are prone to tilt or fall out of position due to their light weight if they are not placed into the receptacle with care.

To be effective, the packing of a receptacle requires the containers to be packed with care and precision. This is often difficult to achieve with regularity with most packing devices known in the art, as discussed above. Contributing to the problem of packing containers into a receptacle with precision is the use of plastic liners in receptacles. Plastic liners are used in receptacles such as cardboard boxes to prevent water or moisture from damaging the containers. However, the folds, creases, and excess plastic of the liners often cause the containers in the receptacle to tilt or fall out of position.

Accordingly, it is desirable to provide a packing apparatus that can accurately and rapidly pack multiple layers of containers into a receptacle with precision. It is also desirable to provide a packing apparatus that can pack multiple layers of containers into a receptacle in a preselected pattern.

SUMMARY OF THE INVENTION

The present invention relates to a packing apparatus for packing a plurality of containers delivered to a packing location into a receptacle in a preselected pattern. The packing apparatus includes a placement assembly and a carriage assembly. The placement assembly has a plurality of container pickup devices mounted on one end of a moveable arm. The arm is moveable so that the container pickup devices can pick up the containers from the packing location and transfer them to the receptacle. The carriage assembly includes a moveable carriage that supports the receptacle. The moveable carriage is adapted to move relative to the placement assembly to enable the containers to be placed into the receptacle in the preselected pattern. A system controller is provided for adjustably controlling the timing, sequence, and movement of the carriage assembly and the placement assembly, both individually and relative to each other, to place and pack the containers into the receptacle in the preselected pattern.

BRIEF DESCRIPTION OF THE DRAWINGS

For purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
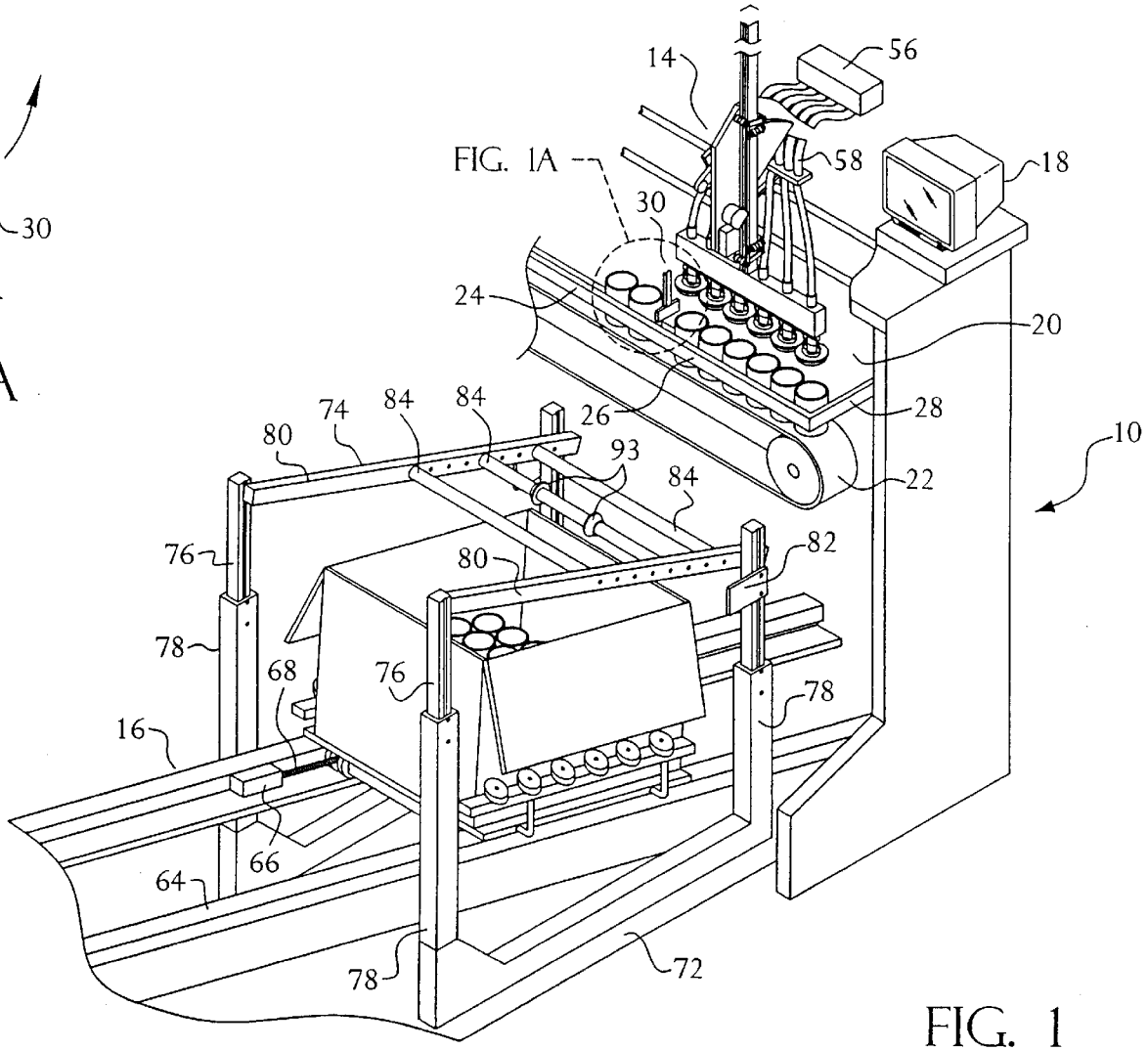
FIG. 1 is a perspective view showing a portion of the packing apparatus according to the invention.

Referring to the drawings, wherein like numerals indicate like elements, there is shown a packing apparatus 10 for packing multiple layers of containers into a receptacle 11 in a preselected pattern. The invention is discussed herein for an application where the containers to be packed are cylindrically shaped, empty containers 12, which may be made of plastic material, and the receptacle 11 is a typical cardboard box or carton. However, the packing apparatus 10 is applicable to numerous other types of items, products, or goods that may be packed into a variety of different types of receptacles 11.

Referring to FIG. 1, the packing apparatus 10 of the present invention includes a placement assembly 14, a carriage assembly 16, and a system controller 18. In the illustrated embodiment, the system controller 18 controls the timing, sequence, and movement of the placement assembly 14 and the carriage assembly 16, individually and relative to each other, to place and pack the containers 12 into the receptacle 11 in a preselected pattern.

As shown in FIG. 1, the containers 12 are delivered from a source (not shown) to a packing location 20, located under the placement assembly 14. The containers 12 are delivered on a conventionally driven conveyor 22 in a single file, one after each other, moving from left to right as seen in the illustrative figures. Each container 12 has an open top facing upwardly and a bottom which rests on the conveyor 22.

The containers 12 are accumulated at the packing location 20 by a stopping device or bar 24. The stopping device 24 is situated at the end of the packing location 20 and includes a first rail 26 and a second rail 28. The first rail 26 extends longitudinally along and parallel to one side of the conveyor 22. The first rail 26 helps to prevent the containers 12 from falling off the conveyor 22 as they accumulate at the packing location 20. The second rail 28 is connected to one end of the first rail 26 and extends across the conveyor 22 to prevent the containers 12 from advancing beyond the packing location 20. As shown, the first and second rails 26,28 cause the containers 12 to arrange themselves into a line below the placement assembly 14.

Figure 1A:
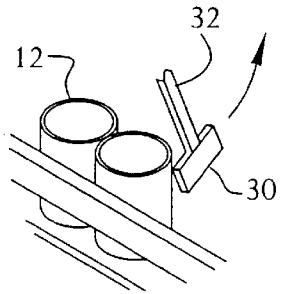
FIG. 1A is an isolated view, greatly simplified, of a sensor used in the packing apparatus according to the invention.

As illustrated in FIGS. 1 and 1A, a sensor 30 is provided along the direction of movement of the conveyor 22, located toward the rear of the packing location 20, for sensing when a preselected number of containers 12 have accumulated. The sensor 30 includes a pendulum-type contact member 32 that lies in the path of movement of the containers 12 and is caused to swing in response to contact with each container 12 that is advanced toward the placement assembly 14 by the conveyor 22. As each container 12 passes the sensor 30, it will contact and cause contact member 32 to swing out of position relative to the contour of the container 12, as shown in the isolated view of sensor 30 of FIG. 1A. After the container 12 passes, contact member 32 will return to its initial position until it contacts another container 12. By sensing the movement of contact member 32, the number of containers 12 can be counted.

When a preselected number of containers 12 have accumulated at the packing location 20, no more containers 12 can move past sensor 30, and thus the contact member 32 will stop swinging. Once the contact member 32 stops swinging, a processor associated with the sensor 30 will generate and relay a status signal to the system controller 18, indicating that the preselected number of containers 12 have accumulated. Once the status signal is received, the system controller 18 will respond by coordinating the movement of the placement assembly 14 and the carriage assembly 16 to pack the receptacle 11. Those of ordinary skill in the art will appreciate that other means for determining when the preselected number of containers 12 have been accumulated at the packing location 20 may be used, such as photo sensors, electronic or mechanical counters, and other types of devices, as a few examples.

Figure 2:
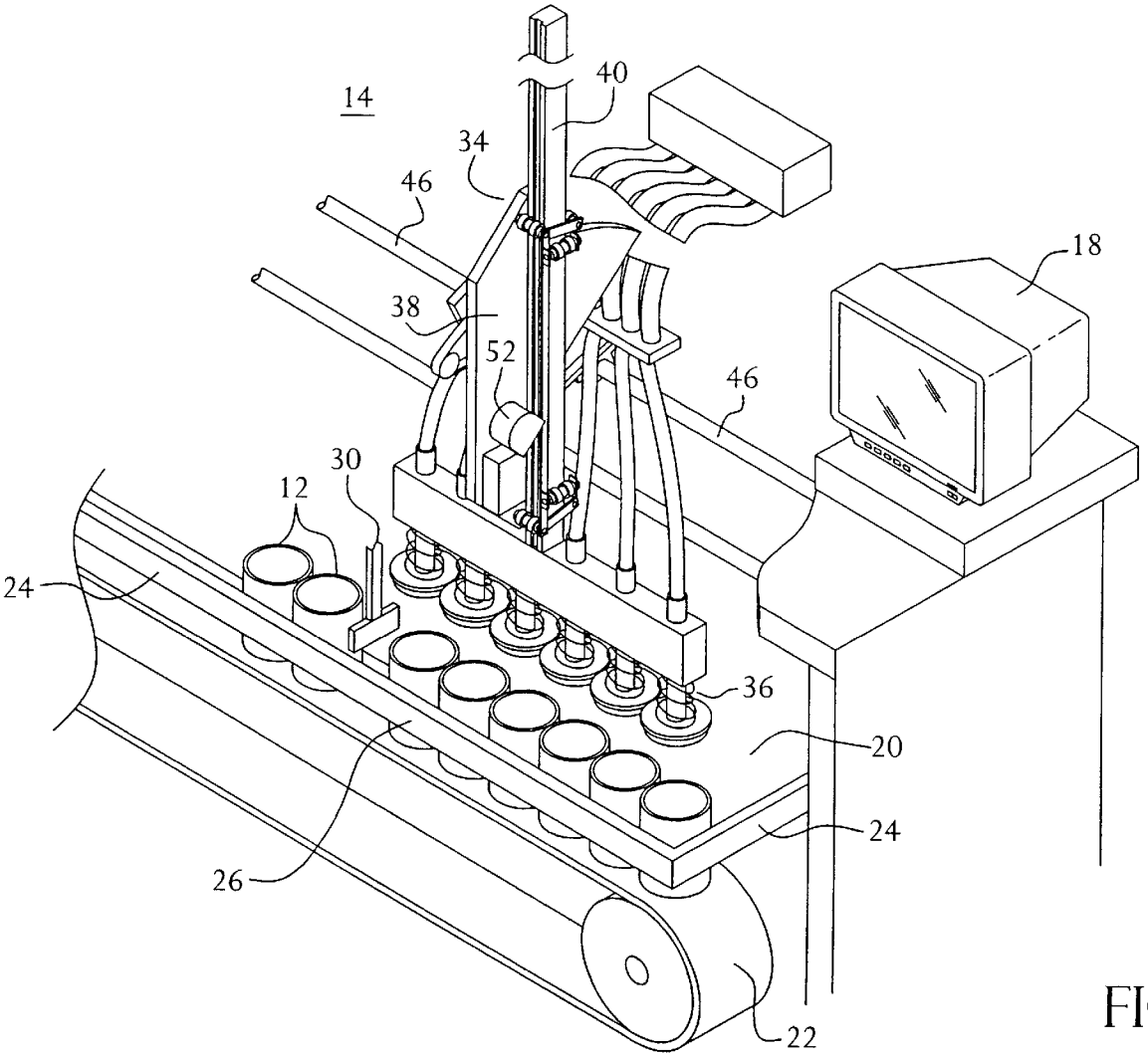
FIG. 2 is a perspective view of a placement assembly of the packing apparatus, shown relative to a plurality of containers accumulated at a packing location.

Turning now to FIG. 2, the placement assembly 14 is shown. The placement assembly 14, which may also be referred to as a placement device, includes a moveable arm or transfer apparatus 34 and a plurality of container pickup devices or suction elements 36. For illustrative purposes, six container pickup devices 36 are shown, it being understood that any number may be used without departing from the invention. The moveable arm 34 includes a first arm member 38 and a second arm member 40.

The first arm member 38 is pivotably secured to a shift assembly 42 (best seen in FIG. 3) by a pivot mechanism 44. The shift assembly 42 is provided so that the placement assembly 14 can move both laterally and rotationally to pick up the containers 12 from the packing location 20 and transfer them to the receptacle 11. The shift assembly 42 is movably secured to a support track 46, positioned over the packing location 20. The support track 46 is in the form of a pair of spaced apart rails (best seen in FIG. 2) that extend parallel to the direction of movement of the conveyor 22. A drive mechanism is operatively connected to the shift assembly 42 so that the shift assembly 42 can move laterally along the rails. The drive mechanism responds to command signals generated by the system controller 18.

The pivot mechanism 44 is provided to allow the first arm member 38 to rotate relative to the shift assembly 42 and the packing location 20. The pivot mechanism 44 includes a base plate 48 secured to the first arm member 38. The base plate 48 has a shaft about which the first arm member 38 rotates. In the embodiment shown in FIGS. 2 and 3, the first arm member 38 rotates in a vertical plane perpendicular to the packing location 20. The rotation of the first arm member 38 may be anywhere between 0° and 180°, although 0° to 90° is presently preferred. For purposes of illustration and discussion only, the first arm member 38 shown in FIGS. 2 and 3 may be considered to be in its full upright vertical position at 0° and is adapted to rotate radially both clockwise and counterclockwise relative to the packing location 20. Those of ordinary skill will appreciate that the rotation of the first arm member 38 does not have to be within a vertical plane. It is contemplated that the rotation of the first arm member 38 can have any orientation that may be desired, such as horizontally, so that the placement assembly 14 can pick up the containers 12 from the packing location 20.

It should be appreciated that mounting the first arm member 38 to the shift assembly 42 as described above, for lateral movement of the placement assembly 14, provides several advantages. The shift assembly 42 provides flexibility in the design and location of the components of the present invention, such as the location of placement assembly 14 and packing location 20. The lateral movement of the placement assembly 14 may be used to eliminate any problems associated with aligning the packing location 20 with the position of the receptacle 11 to be packed. For example, the system controller 18 may be used to maintain the coordinates of the packing location 20 and the coordinates of the position of the receptacle 11 to be packed. As a result, the system controller 18 can move the shift assembly 42 along the support track 46 as necessary, so that the placement assembly 14 can pick up the containers 12 from the packing location 20 and transfer them to the receptacle 11. As such, the physical position of the packing location 20 and position of the receptacle 11 to be packed can vary and is not limited to the precise arrangement shown in the drawings.

Figure 3:
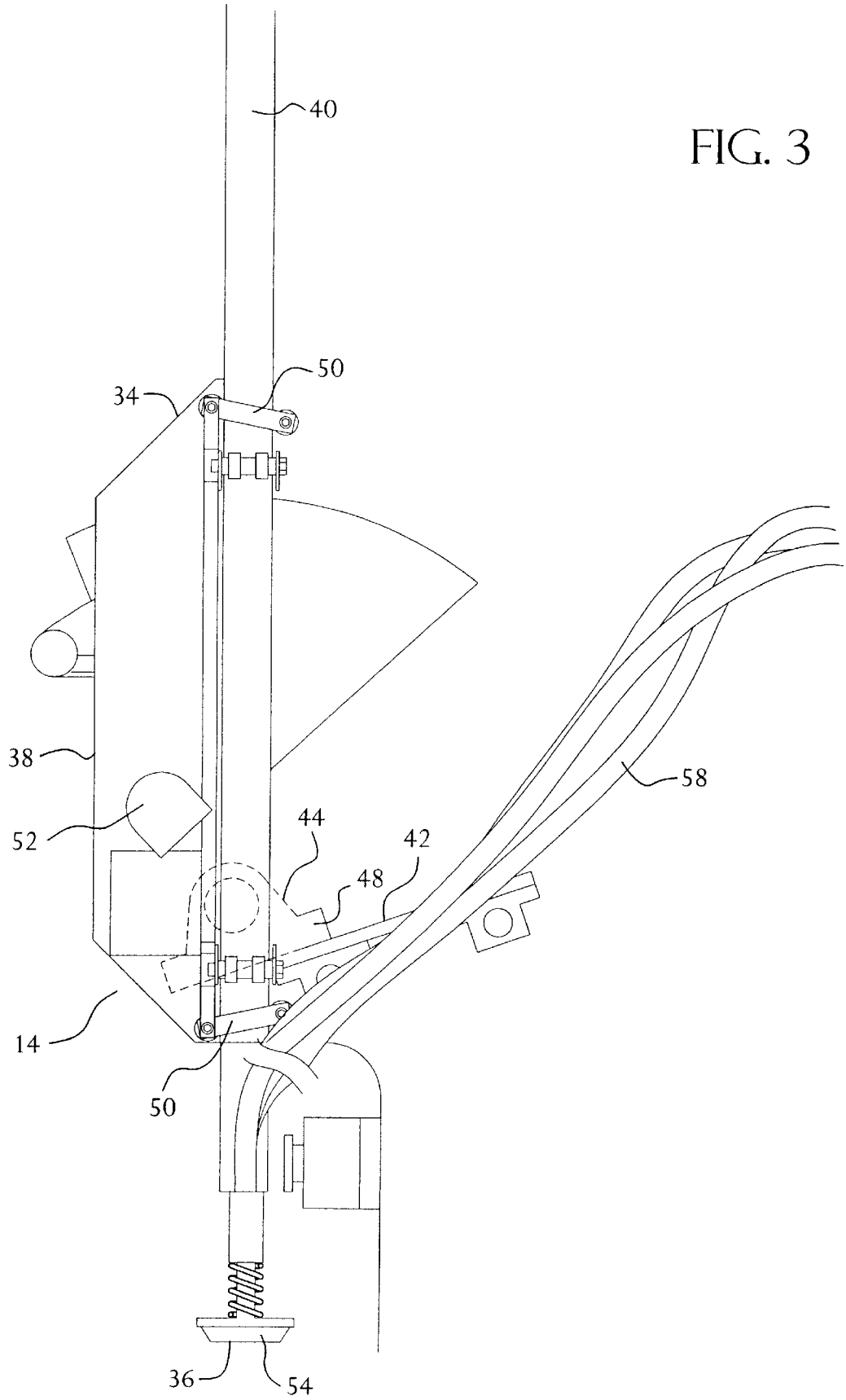
FIG. 3 is a side elevational view, greatly simplified, of the major parts of the placement assembly shown in FIG. 2.

As further shown in FIG. 3, the second arm member 40 is both extendable and retractable relative to the first arm member 38 to pick up the containers 12 from the packing location 20 and transfer them to the receptacle 11. As shown, the second arm member 40 is movably captive within a pair of guide members 50 which depend from the first arm member 38. Each guide member 50 includes a pair of rollers or bearings positioned on opposite sides of the second arm member 40 so that the second arm member 40 may slide relative to the first arm member 38. Other means or mechanical devices for permitting the second arm member 40 to move relative to the first arm member 38 may be used.

In operation, as the first arm member 38 rotates, it will take with it the second arm member 40 which is held by the guide members 50.

Once the first arm member 38 has been rotated to the desired radial position, the second arm member 38 can be extended or retracted relative to the first arm member 40. As the second arm member 40 is extended, it will slide along the guide members 50 in a plane generally parallel to the radial position of the first arm member 38. To retract the second arm member 40, it is moved upwardly in an opposite direction relative to the first arm member 38.

The movement of both the first arm member 38 and the second arm member 40 is controlled by an actuator 52. The actuator 52 includes a motor or other form of mechanical device that responds to command signals generated by the system controller 18. The actuator 52 may include a spring or pulley system that is operatively connected to the first arm member 38 to help it rotate relative to the pivot mechanism 44 of the shift assembly 42.

For example, when the system controller 18 receives the status signal from the sensor 30, it will respond by activating the actuator 52. The actuator 52 will rotate the first arm member 38 to its full vertical position at 0°, as illustrated in FIGS. 2 and 3. Next, the system controller 18 causes the actuator 52 to extend the second arm member 40 downwardly so that the container pickup devices 36 can pick up the containers 12 that have accumulated at the packing location 20.

Figure 4:
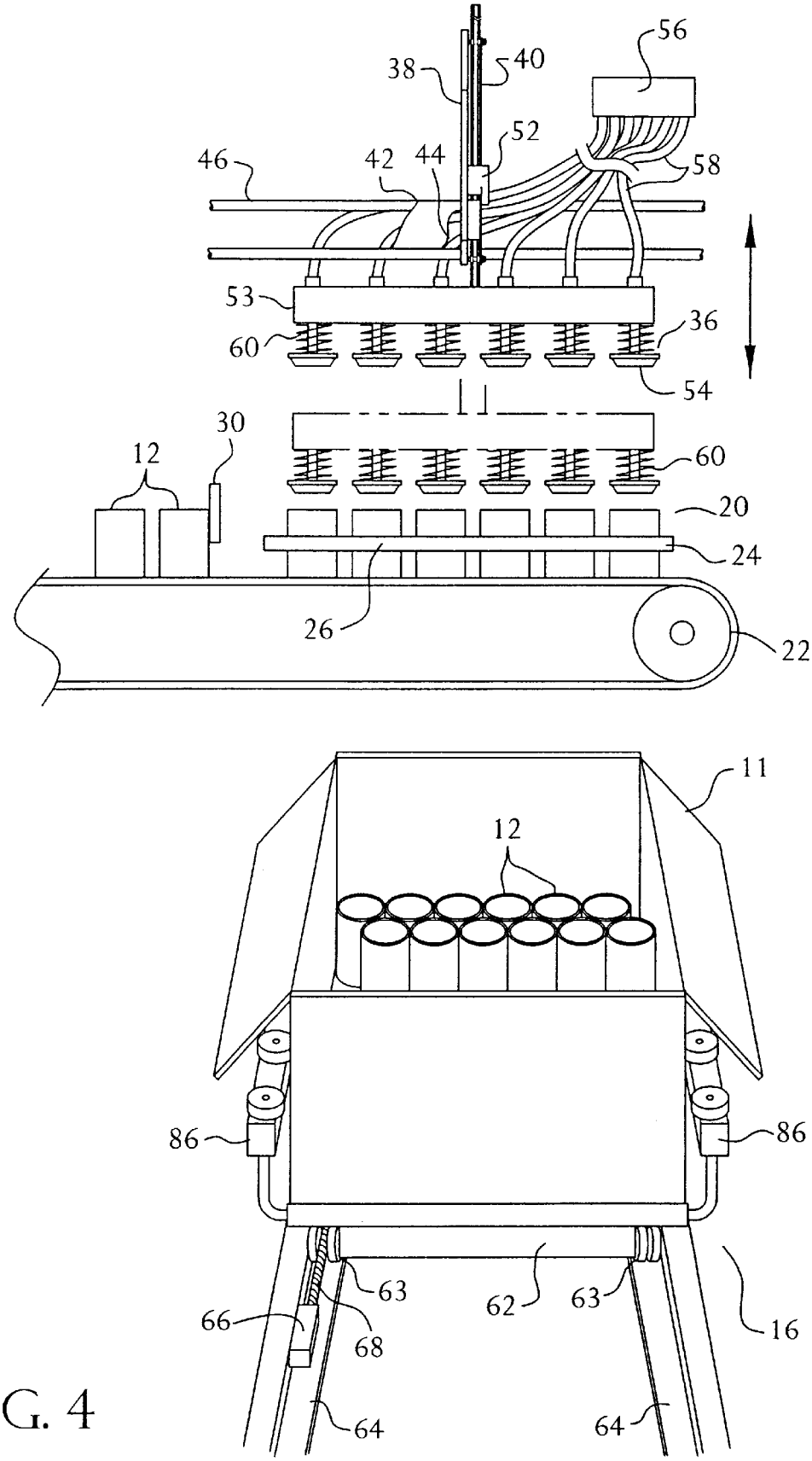
FIG. 4 is a front view, greatly simplified, of the major parts of the placement assembly shown in FIG. 2, relative to a carriage assembly supporting a receptacle to be packed with the containers.

Turning now to FIG. 4, the container pickup devices 36 are shown. The container pickup devices 36 are mounted on one end of the moveable arm 34. As shown in FIG. 4, the container pickup devices 36 are supported by a support member 53 secured to the lower end of the second arm member 40. Each container pickup device 36 includes a suction head 54 in pneumatic communication with a suction source 56 via a suction line 58 as shown in FIG. 24. Each suction head 54 is shaped and dimensioned to engage at least one container 12 at the packing location 20. In the preferred embodiment of FIG. 4, the suction heads 54 are beveled downwardly, or tapered, to sealably fit within the open top of the containers 12.

As illustrated in phantom in FIG. 4, the container pickup devices 36 are moveable up and down. In operation, the container pickup devices 36 are moved downwardly by the extension of the second arm member 40 relative to the first arm member 38 until each suction head 54 has engaged the open top of at least one container 12. A compression spring 60 is mounted intermediate the suction heads 54 and the support member 53. The compression spring 60 absorbs a portion of the downward movement of the second arm member 40 and also urges the suction heads 54 into close contact with the containers 12 so that the suction heads 54 will not damage the container 12 upon engagement and so that a good seal is assured. After the suction heads 54 engage the open tops of the containers 12, thereby sealing the interior thereof, the system controller 18 will activate the suction source 56 to enable the container pickup devices 36 to pick up the containers 12 through suction.

Those of ordinary skill in the art will appreciate that other types of gripping or grasping devices other than suction heads, such as robotic arms, hands, or other mechanically operated devices, may be used to grasp and pick up the containers 12. Moreover, the suction heads 54 can be shaped to pick up any type of container 12, including containers that are filled and have a lid or top secured thereto.

Once the suction source 56 is activated and suction is created, the actuator 42 will retract the second arm member 40 upwardly relative to the first arm member 38 to clear the packing location 20. As a result, the container pickup devices 36 will pick up or lift the containers 12 from the conveyor 22, holding them by suction. As the second arm member 40 clears the packing location 20, another set of containers 12 will begin to accumulate at the packing location 20.

The suction created in the container pickup devices 36 may also be advantageously used to detect defects in the containers 12. A sensor may be provided that measures the flow rate of air drawn in by the suction source in each container pickup device 36. The sensor may generate and relay a signal to the system controller 18 relative to the flow rate. The system controller 18 may then calculate and maintain a running average of the flow rate of the container pickup devices 36, which may be used, in turn, to measure the flow rate in each suction head 54. If the flow rate of any particular container pickup device 36 exceeds a certain level above the average, the system controller 18 may generate a condition signal that identifies the container pickup device 36 on a display. In turn, the condition signal may be used to indicate that the container pickup device 36 did not properly seal or engage the container 12 or to indicate that the container 12 is defective. Devices to measure the airflow or suction as discussed above are known in the art, and are available from several manufacturers.

Figure 5:
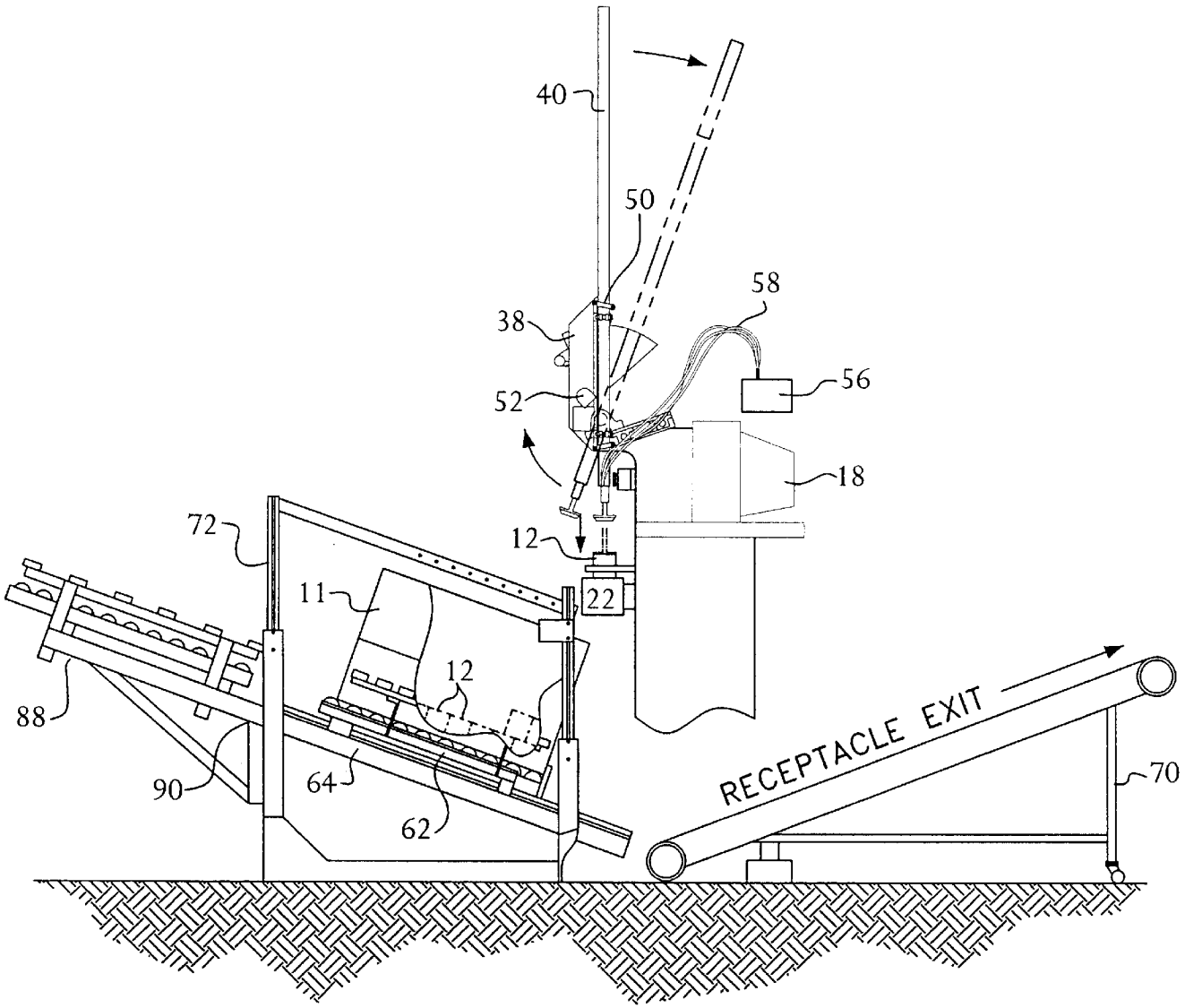
FIG. 5 is a side elevational view of the placement assembly and carriage assembly shown in FIG. 4, illustrating the pick up of the containers from the packing location and the rotation of a portion of the placement assembly to a precalculated placement position.

As further shown in FIG. 4, the carriage assembly 16 is situated below the placement assembly 14. Preferably, the carriage assembly 16 is angled relative to the placement assembly 14 or to the horizontal so that it has a lower end underneath a portion of the packing location 20, as seen in FIGS. 4 and 5. The angle of the carriage assembly 16 facilitates the placement, packing, and arrangement of the containers 12 in the receptacle 11, as discussed in more detail below. Although any angle may be chosen, 20° is presently preferred.

The carriage assembly 16 includes a moveable carriage 62 that supports the receptacle 11. The carriage 62 includes a pair of wheels 63 adapted to travel on a support assembly or track 64 having a pair of spaced apart rails that extend underneath a portion of the placement assembly 14(see FIGS. 4 and 5). An actuator 66 located toward the rear of the track 64 controls the movement of the carriage 62. The actuator 66 includes a drive or a motor mechanically coupled to the carriage 62 by an adjustable length mechanism 68, such a threaded shaft as shown in FIG. 4. In operation, the motor will rotate the shaft in a first direction to cause the carriage 62 to move downwardly on the track 64 to a position underneath the placement assembly 14. When the motor is reversed, the carriage 62 will move in a second direction away from the placement assembly 14. The timing, sequence, and movement of the carriage 62 by the actuator 66 is controlled by the system controller 18 to enable the carriage 62 to accurately position the receptacle 11 to receive the containers 12.

FIG. 5 shows a portion of the packing apparatus 10 to illustrate the packing of the containers 12 into the receptacle 11. As shown and discussed above, the carriage assembly 16 is disposed preferably at a 20° angle relative to the horizontal. The placement assembly 14 is in the full upright vertical position. With the placement assembly in the vertical position, the second arm member 40 of the placement assembly 14 is extended downwardly (shown in phantom) and retracted upwardly to pick up the containers 12 at the packing location 20. Next, the first arm member 38 of the placement assembly 14 is rotated clockwise, taking with it the second arm member 40. The first arm member 38 is rotated so that the containers 12 supported by the second arm member 40 clear the packing location 20 (also shown in phantom). The degree of rotation of the first arm member 38 is selected by the system controller 18, relative to a precalculated placement position.

The precalculated placement position is calculated by the system controller 18. The system controller 18 will maintain data relative to the dimensions of the receptacle 11 (such as the length, width, and height) and the dimensions of each container 12 (such as the diameter, cross-section, and height). The way in which the system controller 18 may be programmed to receive, store, and process such data is well within the skill of the ordinary artisan and need not be described in detail. Based upon this data, the system controller 18 will calculate the number of rows, columns, and/or layers of containers 12 that may be packed into the receptacle 11. In accordance with these calculations, the system controller 18 will coordinate the movement of the placement assembly 14 and the carriage assembly 16 to pack the receptacle 11 with a preselected number, rows, layers, and pattern of containers 12.

Figure 6:
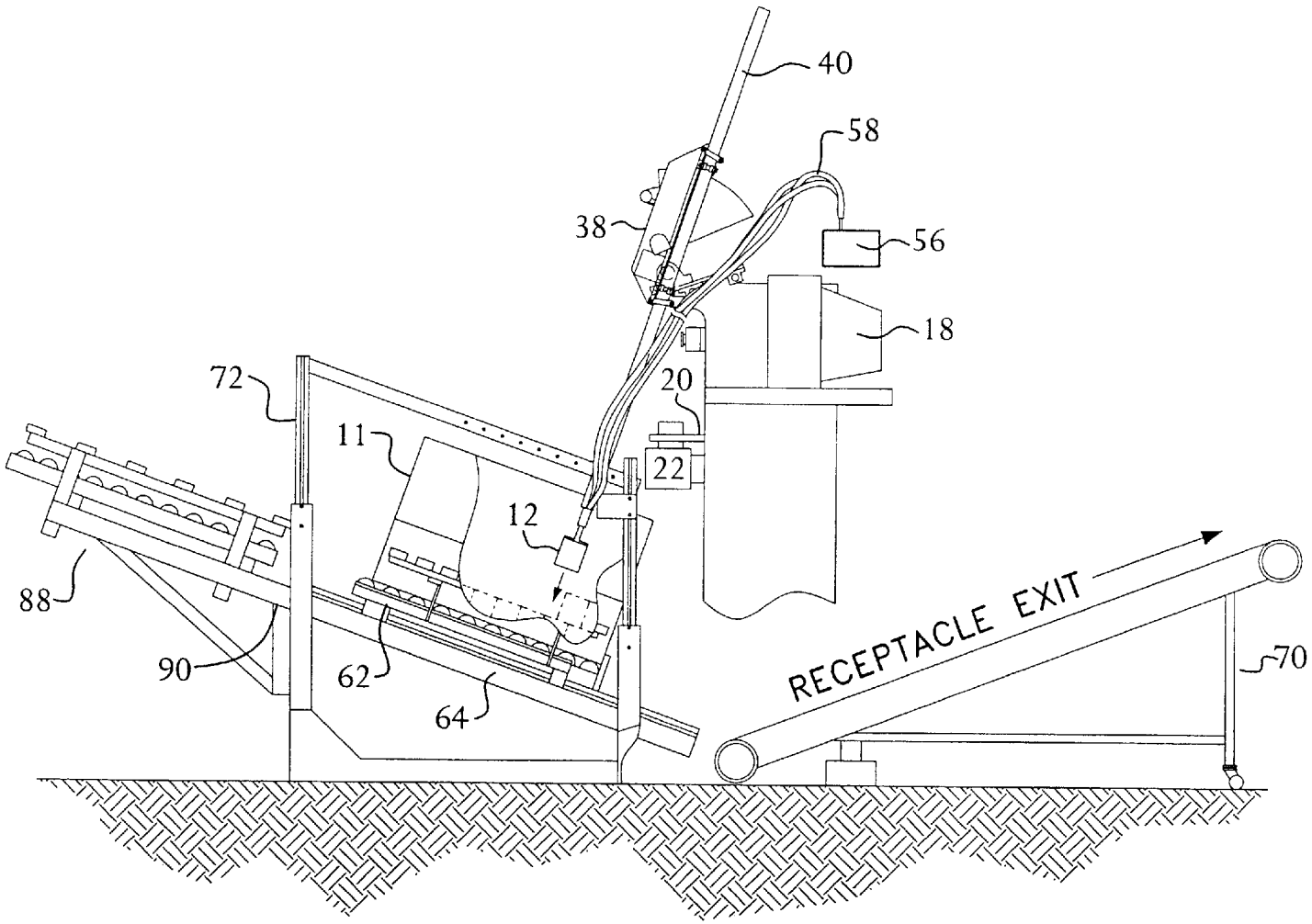
FIG. 6 is a side elevational view of the placement assembly and carriage assembly shown in FIG. 5, illustrating the placement of the containers into the receptacle relative to the precalculated placement position.

Turning now to FIG. 6, the placement and packing of the containers 11 into receptacle 11 is shown. To pack the receptacle 11 shown in FIG. 6 with a preselected number of rows and layers of containers 12, the system controller 18 positions the carriage 62 on the track 64 relative to the precalculated placement position. For purposes of describing the packing process, the first containers 12 placed into the receptacle 11 form a "first" row. The angle of the carriage 62 will cause the first row of containers 12 to lean against the inner surface of the wall of receptacle 11. In this way, the containers 12 will not fall or move out of position.

To place the containers 12 into the receptacle 12, the second arm member 40 is extended downwardly to the precalculated placement position, as illustrated in FIG. 6. After the second arm member 40 has been extended, the system controller 18 will deactivate the suction source 56. By deactivating the suction source 56, the suction created in the pickup devices 36 will begin to decrease so that the suction heads 54 will release the containers 12 after the containers 12 are properly positioned within the receptacle 11. Preferably, air jets associated with each container pickup device 36 are used to facilitate the release of the containers 12. The air jets are in communication with a source, such as an air compressor, that is under the control of the system controller 18. In operation, once the carriage assembly 16 and the placement assembly 14 have moved the container pickup devices 36 into proper position relative to the precalculated placement position, the system controller 18 will activate the compressor. Once the compressor is activated, the air jets will emit a stream or blast of air under pressure to cause each container 12 to disengage from the suction heads 54. The use of air jets or similar devices permits rapid release and placement of the containers 12 into the receptacle 11, which may be necessary if it takes too long for the suction in the suction head 46 created by the suction source 56 to sufficiently decrease to release the containers 12 at the time of placement.

To place the next succeeding row of containers (i.e., a "second" row), the system controller 18 will cause the placement assembly 14 to pick up the containers 12 accumulated at the packing location 20 and transfer them to the receptacle 11, as previously described above. Prior to the containers 12 actually being placed in the receptacle 11, the system controller 18 will incrementally move the carriage 62 downwardly on the track 64 (toward the right as illustrated in FIG. 6) to position the receptacle 12 relative to the precalculated placement position. After the carriage 62 has been moved and is in the proper position, the placement assembly 14 will place the containers 12 into the receptacle 11 at the precalculated placement position to form the second row.

The angle of the carriage 62 on the carriage assembly 16 will cause neighboring rows of containers 12 to lean against each other. In that way, each container 12 will remain in position and will not interfere with the placement of incoming containers 12. Of course, the angle of the carriage assembly 16 may be eliminated, such that the carriage 62 will move in a plane under the placement assembly 14 that is generally parallel to the horizontal. If the angle is eliminated, the placement assembly 14 will have to move to an extent sufficient not only to clear the packing location 20 but also to place the containers 12 into the receptacle 11 positioned underneath.

With further reference to FIG. 6, the system controller 18 will move the carriage assembly 16 and the placement assembly 14, relative to each other, until the last or "nth" row of containers 12 is packed into the receptacle 11 which, in turn, forms a first layer of containers 12. After the last row is packed, the carriage 52 is moved upwardly on the track 64 (to the left as illustrated in FIG. 6) so that a "first" row of a "second" layer of containers 12 may be placed into the receptacle, in the same way the first row of the first layer of containers 12 was placed. This process may be repeated for as many layers as necessary or desired to fill the receptacle 11. After the receptacle 11 is packed with the preselected number of rows and layers of containers 12, the system controller 18 will move the carriage 62 on the track 64 to a location where the receptacle 11 can be removed either manually or is transferred onto a discharge conveyor 70. As seen in FIGS. 5 and 6, the discharge conveyor 70 has an end located approximate the lower end of the track 64 which lifts the end of the receptacle 11 from the carriage 62 and conveys it upwardly to clear the packing apparatus 10.

Figure 7:
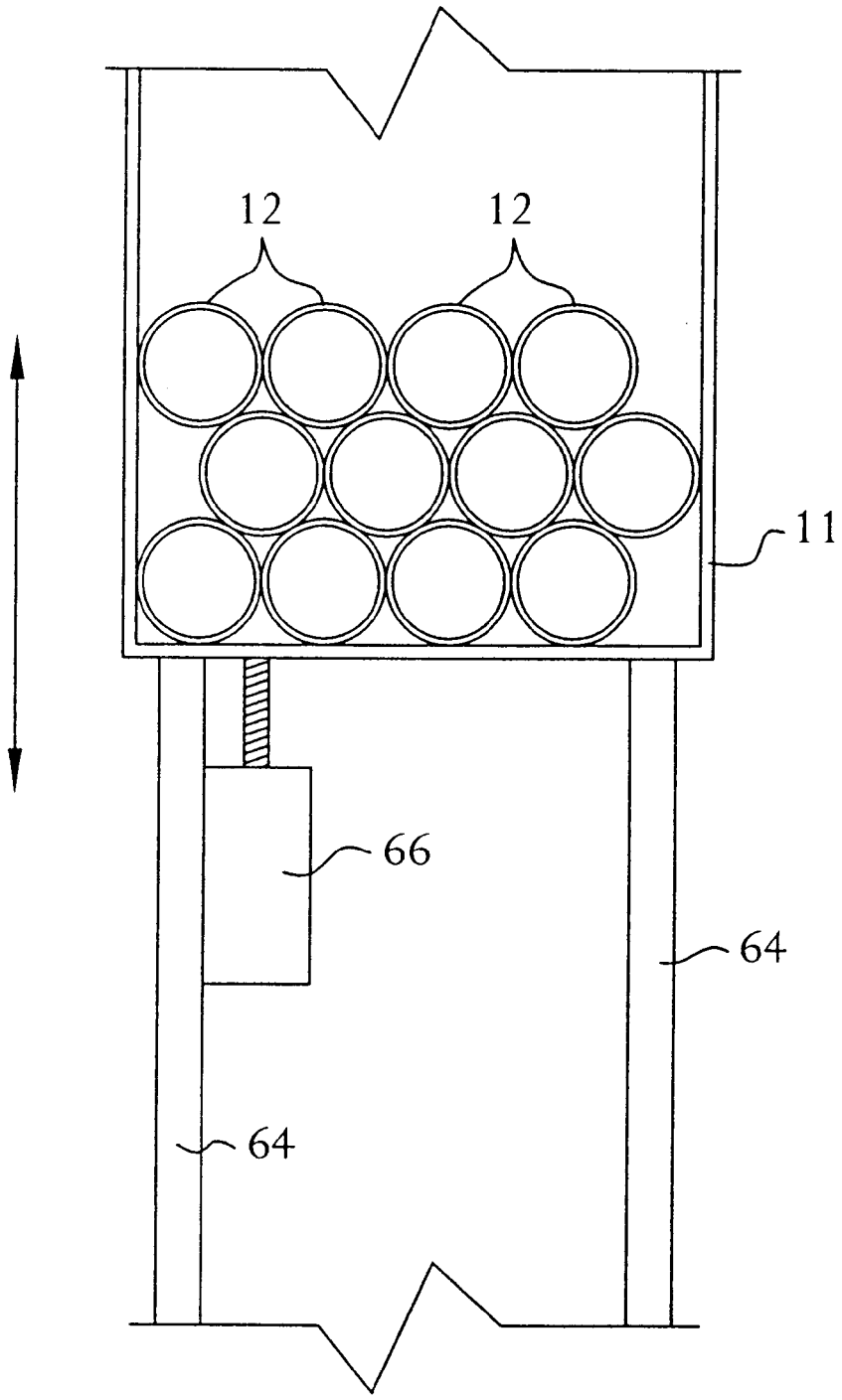
FIG. 7 is a top view of the receptacle shown in FIGS. 5 and 6, with the containers arranged in a preselected staggered pattern.

Those of ordinary skill will appreciate that the packing apparatus 10 of the present invention is flexible enough to permit the containers 12 to be packed into the receptacle 11 in a variety of preselected patterns. As one example, the packing apparatus 10 may be used to pack the receptacle 11 with containers 12 arranged in a staggered pattern. To pack the staggered pattern, the system controller 18 will shift or move the shift assembly 42, and thus move the first arm member 38, laterally along the support track 46, before the containers 12 are placed into the receptacle 11. The first arm member 38 will be moved laterally to offset the position of the containers 12 to be placed into the receptacle 11 relative to those already placed therein and relative to the precalculated placement position. As illustrated in FIG. 7, the second row of containers 12 will be staggered traversely with respect to the first row of containers 12. Moreover, each of the containers 12 of the second row will be nested within a valley formed by two neighboring containers 12 of the first row. The nesting of the containers maximizes the space available within the receptacle 11 for packing the containers 12. To place the next row (i.e., "third" row) of the staggered pattern, the first arm member 38 is returned to its initial position so that the containers 12 will be placed at or relative to the precalculated placement position. To pack the receptacle 11 with a first layer of staggered rows, every other row will be offset as described above and illustrated in FIG. 7.

In the preferred embodiment, the system controller 18 will move the carriage 62 in both a first direction and a second direction prior to placing the containers 12 into the receptacle 11. The carriage 62 will be moved in the first direction to a point below the precalculated placement position. Moving the carriage 62 in this manner will ensure that the containers 12 already placed in the container do not interfere with incoming containers 12. However, just prior to placing the row of containers 12 into the receptacle 11, the carriage 62 is moved in the second direction opposite to the first direction so that the containers 12 are placed at the precalculated placement position. Moving the carriage 62 in the second direction advantageously shifts any containers 12, already placed into the receptacle 11 and that have moved, into the proper preselected pattern. Indeed, moving the carriage 62 in the first direction and the second direction, in addition to the angle of the carriage assembly 14, facilitates the proper arrangement and placement of the containers 12 in the receptacle 11.

As further shown in the preferred embodiment of FIGS. 1, 5, and 6, the packing apparatus 10 includes a hold-down assembly 72. The hold-down assembly 72 is provided to hold down the flaps that may be associated with the receptacle 11. Those of ordinary skill will appreciate that keeping the flaps of a receptacle 11, such as a box, down or out of the way during packing is often difficult. The hold-down assembly 72 helps to eliminate this problem.

As best seen in FIG. 1, the hold-down assembly 72 includes a pair of adjustable height support members 74 located on each side of the track. Because each pair of support members 74 mirrors the other, the remaining components of the support members 74 will be hereinafter described as being representative of both.

Each support members 74 includes a first member 76 moveably disposed within a second member or base 78. The first member 76 is adapted to move up and down relative to the second member 78. An arm 80 is secured to the adjacent first members 76. For purpose of this description only, the portion of the arm 80 attached to the first member 76 situated closest to the packing location 20, will be referred to hereinafter as a "first end". The portion of the arm 80 attached to the first member 76 furthest from the packing location 20, will be referred to hereinafter as the "second end".

An actuator 82 is secured to the first end of the arm 80. The actuator includes a pressure cylinder in fluid communication with a pressure source via a flow line. The cylinder includes a shaft 91 having one end operatively connected to the first end of the arm 80 relative to the second end. As the cylinder is pressurized, shaft 91 extends to raise the first end of the arm 80. To lower the arm 80, the cylinder can be pressurized in the opposite direction to retract the shaft 91.

Togther, each of the arms 80 support opposite sides of a plurality of rollers 84. The rollers 84 are provided to make light contact with the top edge of the receptacle 11, in order to hold the flaps down. Each roller 84 is journaled at different locations into a plurality of holes provided within the arms 80. As illustrated in FIG. 1, the rollers 84 are not evenly spaced. One roller 84 is located downstream (i.e., proximate the first end) and the other is located upstream (i.e., proximate the second end). Although three rollers 84 are shown, any number of rollers 84 may be used.

In operation, the system controller 18 will pressurize the cylinder to raise the first end of the arms 80. As the first end of the arms 80 are raised, the system controller 18 will move the carriage 62 of the carriage assembly 16 into position so that the placement assembly 14 can place the containers 12 into the receptacle 11. After the carriage 62 has moved into position so that the first row of containers 12 can be placed, the system controller 18 will cause the actuator 82 to retract the shaft to lower the arms 84. The arms 80 are lowered until the rollers 84 make light contact with the top edge of the receptacle 11. Flap rollers 93 may be used with receptacles 1 with the flaps up.

In an alternative embodiment, a photo sensor may be used to sense when the receptacle 11 on the carriage 62 is in position. The photo sensor will generate and relay a stats signal to the system controller 18. The system controller 18 will respond to the status signal from the photo sensor to pressurize the cylinder of the actuator 82 to raise and lower the arm 84, as described above.

In an alternative embodiment, the carriage 62 may also include a pair of oppositely disposed rollers 86, as best seen in Figure land 4. The rollers 86 are mounted on a support that is secured to the carriage 62 and help to guide the location of the receptacle 11 on the carriage 62. The rollers 64 may also be advantageously used be used to hold down the bottom end of the flaps or carton down members associated with receptacles 11 so the flaps will not interfere with the packing of the receptacle 11.

In an alternative embodiment, the carriage 62 may be associated with an additional suction device (not shown). This particular suction device may be used to draw excess air that may form between plastic liners and the inside of the receptacles. This will reduce the air pockets that otherwise form when plastic liners are used. Such air pockets have a tendency to form folds and creases in the plastic liners which may cause the containers 12 placed into the receptacle 11 to fall or tilt out of position or into the path of incoming containers.

In yet another alternative embodiment, a receptacle 11 in-feed assembly 88 may be used, as shown in FIGS. 5 and 6. The in-feed assembly 88 is used to support empty receptacles 11 that will be transferred to and received by the carriage 62. As shown, the in-feed assembly 88 has an end 90 in communication with the track 64 of the carriage assembly 16, and is also disposed at an angle to the horizontal. In operation, an empty receptacle 11 is received in the in-feed assembly 88 and awaits the carriage 62. After the carriage 62 has delivered a packed receptacle 11 to the discharge conveyor 70, it will move upwardly on the track 64 to the in-feed assembly 88. Once the carriage 62 comes into close proximity with the end 90 of the in-feed assembly 88, the empty receptacle 11 is released and received in the carriage 62. After the empty receptacle 11 is received in the carriage 62, the carriage 62 is moved into position by the system controller 18 to receive the containers 12 as previously described.

Persons skilled in the art will recognize that there may be different devices, mechanisms, and methods of operation which are within the spirit and scope of the invention as defined in the claims. Also, it should be understood that the drawings, while useful in illustrating the invention, are not intended to be necessarily to scale. The dimensions and relative sizes and locations of the various parts shown can be varied, depending upon the particular receptacle 11 being packed, the size and dimensions of the containers 12, and the like, without departing from the scope of the invention. To the extent that the drawings imply dimensions and relative size positions, the drawings should be regarding as illustrative only and not limiting the invention to particular dimensions, sizes, position, and location of parts.

Finally, the present invention may be embodied in other specific forms without departing from the spirit or essential attributes thereof and, accordingly, reference should be made to the appended claims, rather than to the foregoing specification, as indicating the scope of the invention.

I claim:

1. A packing apparatus for packing a plurality of containers delivered to a packing location into a receptacle, the packing apparatus comprising:

a placement assembly having a plurality of container pickup devices mounted on one end of a moveable arm, the arm being moveable so that the container pickup devices can pick up the containers from the packing location and transfer the containers to the receptacle and the container pickup devices being selectively shiftable transverse to the direction of transfer from the packing location to the receptacle, a carriage assembly supporting the receptacle and having a moveable carriage, the carriage being moveable relative to the placement assembly to enable the containers to be placed into the receptacle in a preselected pattern, and a system controller for adjustably controlling the timing, sequence, and movement of the carriage assembly and the placement assembly, relative to each other, to pack the containers in the receptacle in said preselected pattern.

2. The packing apparatus as claimed in claim 1, wherein the container pickup devices comprise suction heads.

3. The packing apparatus as claimed in claim 2, wherein each suction head is shaped and dimensioned to engage and pick up at least one container.

4. The packing apparatus as claimed in claim 1, further comprising a first actuator arranged to move the arm and a second actuator arranged to move the carriage, wherein the first and second actuators are activated by the system controller.

5. The packing apparatus as claimed in claim 1, wherein the arm further comprises a first arm member and a second arm member extendable and retractable relative to the first member, the second member supporting the container pickup devices.

6. The packing apparatus as claimed in claim 5, wherein the second arm member is extendable and retractable under control of the system controller.

7. The packing apparatus as claimed in claim 1, wherein the carriage assembly is angled relative to the placement assembly to facilitate the arrangement and placement of the containers in the receptacle.

8. The packing apparatus as claimed in claim 1, wherein the carriage is moveable in both a first direction and a second direction opposite the first direction, wherein movement in the second direction shifts the containers placed in the receptacle into the preselected pattern.

9. The packing apparatus as claimed in claim 8, wherein the placement assembly is movable reciprocally in first and second directions at substantially right angles to said first and second directions in which said carriage is movable.

10. The packing apparatus as claimed in claim 1, further comprising a sensor for sensing and generating a status signal when a preselected number of containers are delivered to the packing location, the system controller being responsive to the status signal and moving the placement assembly into position to pick up the containers in response thereto.

11. The packing apparatus as claimed in claim 1, wherein the receptacle is a box.

12. The packing apparatus as claimed in claim 1, wherein the container is cylindrical.

13. The packing apparatus as claimed in claim 1, wherein the container is an empty container.

14. A packing apparatus for packing a plurality of containers delivered to a packing location into a receptacle, the packing apparatus comprising:

a placement assembly having a plurality of pickup devices supported by a transfer apparatus adapted to pick up containers from the packing location, to transfer the containers in a first direction from the packing location and to selectively shift the containers in a second direction transverse to the first direction to a precalculated placement position to place the containers into the receptacle, a moveable carriage supporting the receptacle, the carriage being moveable relative to the precalculated placement position to enable the containers to be placed in the receptacle in a preselected pattern, and a system controller for controlling the timing, sequence, and movement of the transfer apparatus and the moveable carriages relative to each other, to pack the receptacle in said preselected pattern of containers.

15. The packing apparatus as claimed in claim 14, wherein each pickup device includes a suction head in pneumatic communication with a suction source.

16. The packing apparatus as claimed in claim 15, wherein the system controller adjustably moves the transfer apparatus and the carriage pack the receptacle with multiple layers of containers.

17. The packing apparatus as claimed in claim 15, further comprising a sensor for sensing and generating data relative to the flow rate of air drawn into at least one pickup device by the suction source.

18. The packing apparatus as claimed in claim 17, wherein the system controller calculates and maintains an average flow rate of air drawn in each pickup device, based upon data generated by the sensor.

19. The packing apparatus as claimed in claim 18, wherein the system controller generates a status signal when the flow rate of any pickup device exceeds the average flow rate.

20. The packing apparatus as claimed in claim 19, wherein the status signal is used to indicate that the container picked up by the pickup device is defective.

21. A packing apparatus for packing a plurality of items into a receptacle, the packing apparatus comprising:

a placement device having a plurality of suction elements mounted at one end on a moveable arm to pick up the items and place them into the receptacle, a first actuator to move the placement device to and from the receptacle, a second actuator to shift the placement device transversely to the motion caused by the first actuator, a carriage supporting the receptacle, the carriage being moveable relative to the placement device transversely to the shifting caused by the second actuator to enable the items to be released into the receptacle in a preselected pattern, a third actuator to move the carriage, and a system controller for controlling the first actuators the second actuator, and the third actuator relative to each other to pack the items into the receptacle in the preselected pattern.

22. A method of packing a plurality of containers into a receptacle comprising the steps of:

delivering the containers to a packing location, providing a placement assembly to pickup the containers delivered to the packing location and to place the containers into a receptacle, providing a shift assembly to selectively displace the containers relative to the receptacle, providing a moveable carriage assembly to support the receptacle, the moveable carriage assembly positioning the receptacle in a direction transverse to the direction of displacement of the shift assembly to receive the containers to be packed by the placement assembly, moving the placement assembly to transfer containers from the packing location to the receptacle, and adjustably moving both the shift assembly and the carriage assembly, relative to each other, to pack the receptacle with a preselected number and pattern of containers.

23. A method of packing a plurality of containers into a receptacle according to claim 22, further comprising the step of adjustably moving the placement assembly relative to the carriage assembly in a direction toward a wall of the receptacle prior to releasing containers into the receptacle.

24. A packing apparatus for packing a plurality of containers delivered to a packing location into a receptacle, the packing apparatus comprising:

a placement assembly having a plurality of container pickup devices mounted on one end of a moveable arm, the arm being moveable so that the container pickup devices can pick up the containers from the packing location and transfer the containers to the receptacle, the arm comprising a first arm member rotatable relative to the packing location and a second arm member extendable and retractable under control of a system controller relative to the first member, the second member supporting the container pick-up devices, a shift assembly supporting the placement assembly, the placement assembly being shiftable by the shift assembly in a direction perpendicular to the direction of transfer of the containers, a carriage assembly supporting the receptacle and having a moveable carriage, the carriage being moveable relative to the placement assembly in a direction perpendicular to the direction of shifting to enable the containers to be placed into the receptacle in a preselected pattern, and a system controller for adjustably controlling the timing, sequence, and movement of the carriage assembly and the placement assembly, relative to each other, to pack the containers in the receptacle in said preselected pattern.

25. The packing apparatus as claimed in claim 24, wherein the first arm member rotates between 0° and 90°.

26. A packing apparatus for packing a plurality of containers delivered to a packing location into a receptacle, the packing apparatus comprising:

a placement assembly having a plurality of pickup devices supported by a transfer apparatus adapted to pick up containers from the packing location and transfer the containers in a first direction and selectively shift them in a second direction to a precalculated placement position to place the containers into the receptacle, each pick-up device including a suction head in pneumatic communication with a suction source.

a moveable carriage supporting the receptacle, the carriage being moveable incrementally relative to the precalculated placement position to enable the containers to be placed in the receptacle in a preselected pattern of containers in order to pack the receptacle with successive rows of containers, and a system controller for controlling the timing, sequence, and movement of the transfer apparatus and the moveable carriage, relative to each other wherein said controller adjustably moves the transfer apparatus and the carriage to pack the receptacle with multiple layers of containers.

27. The packing apparatus as claimed in claim 26, wherein the carriage is moved in a first direction so that containers to be placed in the receptacle are not interfered with by containers previously placed in the receptacle.

28. The packing apparatus as claimed in claim 27, wherein the placement assembly is offset in said second direction substantially perpendicular to the first direction in which the carriage is moved.

29. A method of packing a plurality of containers into a receptacle comprising the steps of:

(a) delivering the containers to a packing location, (b) providing a placement assembly to pick up the containers delivered to the packing location and to place the containers into a receptacle, (c) providing a moveable carriage assembly to support the receptacle, the moveable carriage assembly positioning the receptacle to receive the containers to be packed by the placement assembly, (d) adjustably moving the placement assembly in a first direction relative to the carriage assembly to insert into the receptacle a preselected number of containers, (e) adjustably moving the placement assembly in a second direction opposite to the first direction prior to releasing the containers into the receptacle, f) adjustably moving the placement assembly in a third direction perpendicular to the second direction prior to releasing the containers into the receptacle, and g) releasing the containers into the receptacle.

30. A method of packing a plurality of containers into a receptacle according to claim 29, further comprising repeating steps (d) through g) a desired number of times to pack the receptacle with a preselected pattern of containers.

* * * * *